US011583081B2

(12) United States Patent
Rowland

(10) Patent No.: US 11,583,081 B2
(45) Date of Patent: Feb. 21, 2023

(54) TILT MECHANISM FOR LOUNGE CHAIR

(71) Applicant: Evan Rowland, Fountain Hills, AZ (US)

(72) Inventor: Evan Rowland, Fountain Hills, AZ (US)

( * ) Notice: Subject to any disclaimer, the term of this patent is extended or adjusted under 35 U.S.C. 154(b) by 0 days.

(21) Appl. No.: 17/507,863

(22) Filed: Oct. 22, 2021

(65) Prior Publication Data

US 2022/0211178 A1 Jul. 7, 2022

Related U.S. Application Data

(60) Provisional application No. 63/133,454, filed on Jan. 4, 2021.

(51) Int. Cl.

| | |
|---|---|
| ***A47C 7/50*** | (2006.01) |
| ***A47C 31/00*** | (2006.01) |
| ***A47C 1/024*** | (2006.01) |
| ***A47C 1/025*** | (2006.01) |
| ***A47C 1/14*** | (2006.01) |

(52) U.S. Cl.
CPC ..... *A47C 1/0242* (2013.01); *A47C 1/025* (2013.01); *A47C 1/143* (2013.01)

(58) Field of Classification Search
CPC ..... A47C 1/0242; A47C 1/025; A47C 1/143
See application file for complete search history.

(56) References Cited

U.S. PATENT DOCUMENTS

| | | | | |
|---|---|---|---|---|
| 5,944,384 | A * | 8/1999 | Patterson | A47C 3/18 297/217.3 |
| 8,002,349 | B1 * | 8/2011 | Pizzuto | A47C 1/143 297/188.05 |
| 11,419,553 | B2 * | 8/2022 | Gehrke | A47C 20/041 |
| 11,419,554 | B2 * | 8/2022 | Gehrke | A61B 5/6892 |
| 2008/0005838 | A1 * | 1/2008 | Wan Fong | A61B 5/7257 5/600 |
| 2011/0049957 | A1 * | 3/2011 | Luwisch | A47C 1/0244 297/377 |
| 2011/0193372 | A1 * | 8/2011 | Pizzuto | A47C 1/143 297/217.3 |
| 2015/0019020 | A1 * | 1/2015 | Hille | A47C 31/008 700/275 |
| 2015/0026890 | A1 * | 1/2015 | Hille | A61G 7/015 5/613 |
| 2020/0143929 | A1 * | 5/2020 | Pathiratne | A47C 7/5066 |
| 2022/0211178 | A1 * | 7/2022 | Rowland | A47C 1/0242 |

* cited by examiner

*Primary Examiner* — Shin H Kim
(74) *Attorney, Agent, or Firm* — Brennan, Manna & Diamond, LLC

(57) ABSTRACT

The device of the present invention allows a user to adjust the back of a chair to a desired reclining angle without having to physically stand up and manually adjust the back of the chair. More specifically, the tilting mechanism provides a remote control for the user to adjust the back of the chair through the touch of a button and moves the chair back from a first position to a second position as well as through a number of angles of inclination.

20 Claims, 8 Drawing Sheets

TILT MECHANISM FOR LOUNGE CHAIR

CROSS-REFERENCE TO RELATED APPLICATION

The present application claims priority to, and the benefit of, U.S. Provisional Application No. 63/133,454, which was filed on Jan. 4, 2021, and is incorporated herein by reference in its entirety.

FIELD OF THE INVENTION

The present invention relates generally to chair tilting or reclining mechanisms that allow the back of a chair to go from an upright position to a reclining position with the touch of a button. More specifically, the present invention relates to a chair tilting mechanism equipped with, among other things, a motor, engaging drive elements, battery, and remote control. The chair tilting mechanism of the present invention allows a user to recline a chair, such as a patio lounge chair, beach chair or lawn furniture with little to no effort, without standing up, walking to the back of the chair, and having to physically adjust the chair's back position.

More specifically, a motor with associated drive elements is attached to the frame of the chair which allows the chair back to automatically adjust from a first, fully upright position to a second, fully reclining position at the touch of a button, such as one provided on a remote control element. Further, the chair back can adjust to any intermediate position between fully upright and fully reclined, thereby providing a plurality of different angular positions. Additionally, the motor is attached to a power source which allows the back of the chair to adjust to the desired reclining angle. The power source may be a battery, electrical cord, solar panel or other suitable energy source. Accordingly, the present disclosure makes specific reference thereto. Nonetheless, it is to be appreciated that aspects of the present invention are also equally applicable to other like applications, devices, and methods of manufacture.

BACKGROUND OF THE INVENTION

By way of background, many individuals enjoy reclining in a chair when reading, sleeping, consuming food or beverages, tanning, napping or socializing. Unfortunately, many lounge chairs that currently provide a reclining option require a manual adjustment. For example, in order for an individual to recline a chair, the individual would need to stand up, walk to the back of the lounge chair, lift the arm or support frame element supporting the chair back, place the arm or supporting frame element into the desired slot or hole and return to sitting or resuming other activities in the chair. In addition, this process would need repeated until the individual is comfortable with the desired reclining angle, which potentially requires moving the arm or supporting frame element many times in order to obtain the correct position.

Further, many individuals utilize chairs while socializing or playing games with other individuals. More often than not, when the individual wants to adjust the reclining angle of the chair, the individual will stop the conversation, game or other activity in order to manually adjust the reclining angle of the back of the chair. This, in turn, may be highly disruptive to the conversation and parts of the conversation may be missed while the individual adjusts the chair.

Therefore, there exists a long-felt need in the art for an improved chair tilting mechanism to allow users to recline a chair without exerting much effort. More specifically, there is a long felt need in the art for a chair tilting mechanism that utilizes a power source that would allow the chair to recline with little or no effort. Additionally, there is a long-felt need in the art for a chair tilting mechanism that provides functionality to allow the user to adjust the reclining angle of the chair back without requiring the user to continuously stand up and manually adjust the chair back. Finally, there is a long felt need in the art for a chair tilting mechanism that is relatively inexpensive to manufacture, and that is both safe and easy to use.

The subject matter disclosed and claimed herein, in one embodiment thereof, comprises a chair tilting mechanism having a tubular motor, power source, gears, break, lock and a remote control. The device is relatively lightweight and can be easily affixed to the chair's cross brace or other frame element that supports the back section of the chair. The motor is generally comprised of a shaft inserted into the housing and driven by a motor. A gear or drive element is affixed to each end of the shaft. End caps or pins, such as carter pins, are placed on the ends of the shaft to secure the gears in place. Further, a power source is attached to the motor housing and connected to the motor, thereby allowing the motor to turn the shaft in both a clockwise and counter-clockwise direction so that the reclining direction can move from a first position to a second position through a number of intermediate positions. The gears mate with a rack gear on the back support rod or frame of the chair. The chair tilting mechanism further includes one or more straps located around the motor housing to hold the housing to the frame such as a cross brace and power source. Moreover, the chair tilting mechanism has a remote control that allows the user to adjust the reclining angle of the chair with the push of a button. The chair alternatively may have a control element built into the chair so that the control is readily accessible to the user and the user does not have to search for the remote control.

In this manner, the novel chair tilting mechanism device of the present invention accomplishes all of the forgoing objectives and provides a relatively safe, easy, convenient and cost-effective solution to allow a user to adjust the reclining angle of a chair with the touch of a button or control switch.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The present invention relates to a novel chair tilting mechanism. As used herein, the term "chair" refers to any type of chair capable to adjusting to a reclining position such as a chaise lounge chair, beach chair, lawn chair or the like. Although the preferred use of the chair tilting mechanism of the present invention is intended for chairs designed for individuals, it is not so limiting, and may be used for any other purpose that may satisfy the needs and/or preferences of the user. In addition, as used herein, the term "power source" refers to any type of power source capable of causing a motor to start and engage the motor mechanisms.

The subject matter disclosed and claimed herein, in one embodiment thereof, comprises a chair tilting mechanism that allows a user to adjust the back or upper portion of a chair between a first position which is a fully upright position, a second position which is a fully reclining position, and a plurality of intermediate positions which is any position in between the first and second positions, at the touch of a button or switch. The motor portion of the device is cylindrical in design and similar to that of a motor used to roll up blinds on a window. The motor has two gears located on opposite ends of the motor and extending out a distance from the ends of the housing. The gears mate with complimentary gears or racks located on the chair back support rods or framing elements and enable the chair back or upper portion of the chair to adjust to the desired reclining position of the individual using the chair. The motor is housed in a compartment that is attached to the power source. The reclining mechanism may also use a break or other stop on the motor to hold the gears in the racks at a desired position.

The power source may be comprised of disposable or rechargeable batteries, solar panel, or connected to a conventional outlet, or the like. The power source may also have an external power supply such as an AC adaptor or electrical cord. The power source may also be permanently or removably affixed to the motor.

In a further embodiment of the present invention, the chair tilting mechanism further comprises a remote control or switch to activate tilting mechanism. The remote control is preferably a generally rectangular shape and size that has two buttons located within the remote control and accessible on the surface of the remote. The buttons allow the user to either recline or sit fully upright in the chair or use one of the intermediate positions. When the desired reclining angle is reached, the user simply ceases depressing the button and the motor will stop. The buttons are located in a convenient location for the user to comfortably hold the remote control and simultaneously depress the desired button.

In a yet further embodiment of the present invention, a mounting system is included to attach the device to the frame of the chair. The mounting system is preferably located near the gears around the opposite ends of the device. The mounting system can include, but is not limited to, straps, hook and loop fasteners, buttons, snaps, buckles or combinations thereof to provide a stable, safe, and secure method for the gears to be aligned with the chair back support rods and gear racks.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1A:
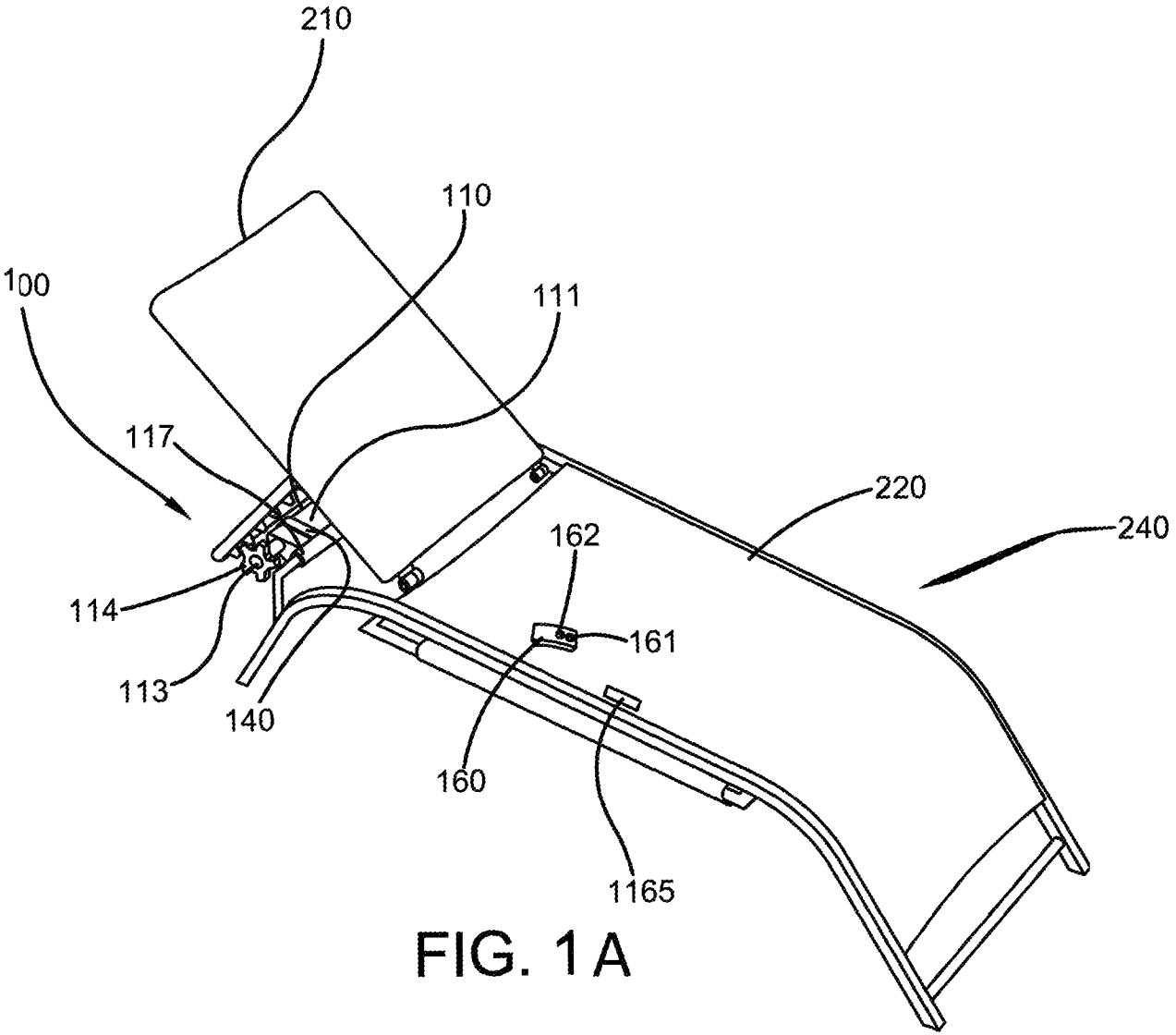
FIG. 1A illustrates a perspective view of one potential embodiment of a chair tilting mechanism of the present invention in accordance with the disclosed architecture, wherein the chair tilting mechanism is supporting the back of a lounge chair in a partially reclining position.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for an improved chair tilting mechanism to allow users to adjust the reclining angle of a chair or upper portion of a chair, lounge, chaise or the like, without requiring the user to continuously stand up and manually adjust the chair back. More specifically, there is a long felt need in the art for a chair tilting mechanism device that utilizes a power source that would allow the lounge chair to recline automatically after activation. Additionally, there is a long-felt need in the art for a chair tilting mechanism that provides a mechanism to allow the user to press a button on a remote control or switch attached to the frame to adjust the reclining angle of the chair. In addition, the control or switch may allow the user to set the angle of inclination of the chair so that the user does not have to hold and release the chair until the back or other portion of the chair reaches the desired position. Finally, there is a long felt need in the art for a chair tilting mechanism device that is relatively inexpensive to manufacture, and that is both safe and easy to use.

Referring initially to the drawings, FIG. 1A illustrates a perspective view of one potential embodiment of a chair tilting mechanism 100 of the present invention in accordance with the disclosed architecture, wherein the chair tilting mechanism 100 is supporting the back of a lounge chair in a partially reclining position. More specifically, the chair tilting mechanism 100 of the present invention is attached to the back support rod 151 of the chair 220 such that the device 100 is parallel to the ground. The remote control 160 is placed on the chair 220 within easy reach. The remote control can be a separate unit or may be physically attached to the frame of the chair 1165. The remote has an up/down button as well as an angle of inclination button or slider and memory settings to allow a preferred position to be set by different users or different settings for an individual user.

The chair 220 has a frame including a chair back 221 that supports the upper body of the user 230 with adjustable back support rods 151 affixed to the chair back 221, thereby allowing for the chair back 221 to recline, remain upright or utilize any other desired angle between the first and second positions. In this particular embodiment, the chair 220 is located in a potential venue 240 with a hard surface. However, the chair 220 may be located on uneven, sandy, wooden or other similar surfaces which the user 230 desires.

Figure 1B:
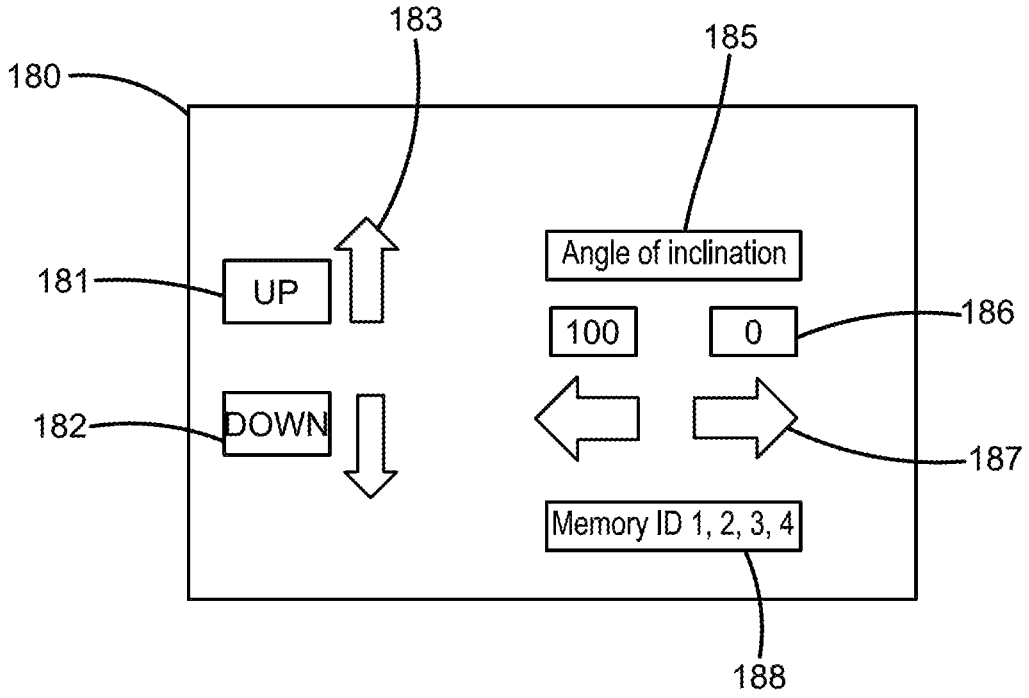
FIG. 1B illustrates a perspective view of one potential embodiment of a control panel of the chair tilting mechanism of the present invention in accordance with the disclosed architecture.

FIG. 1B illustrates a perspective view of one potential embodiment of a control panel or switch 180 of the chair tilting mechanism 100 of the present invention in accordance with the disclosed architecture. More specifically, the control switch 180 includes indicia 181, 182 with the words "up" and "down", respectively, and control buttons 183 showing which direction to move the chair back or upper portion of the chair. Additional indicia 185 is provided near the percentage of angle of inclination indicia 186 and the control buttons 187. Any of the buttons or indicia panels may also be back lit such as with the use of LED lighting allowing a user to see the control panel at night. In addition, the control panel may include a further set of controls 188 having an established set of positions stored in memory so that individual users can set their desired position or alternatively a single user can have his or her preferred positions such as 0, 30, 45 and 90 degrees.

Figure 2:
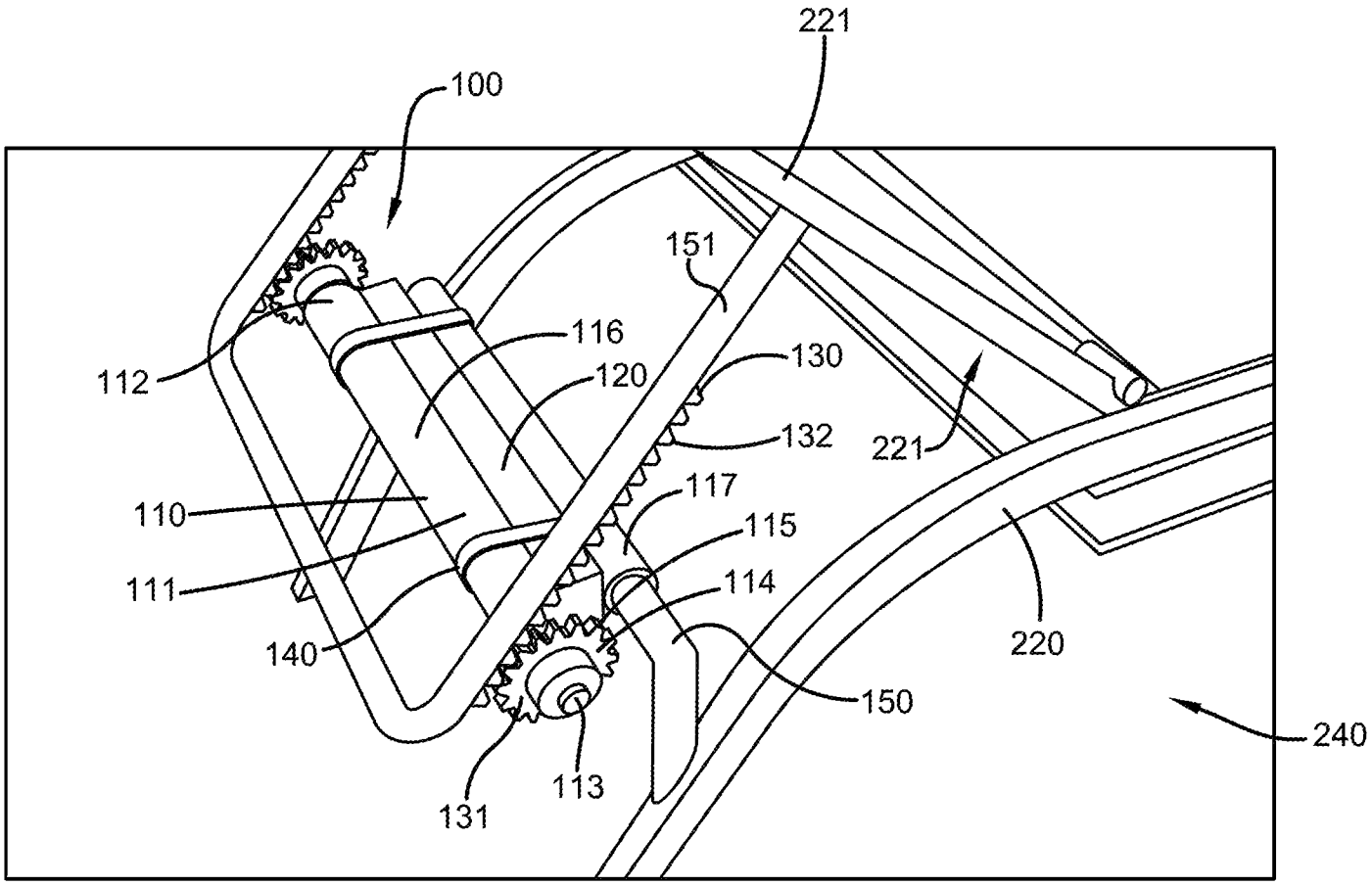
FIG. 2 illustrates a close-up perspective view of one potential embodiment of the chair tilting mechanism of the present invention attached to a lounge chair in accordance with the disclosed architecture.

FIG. 2 illustrates a close-up perspective view of one potential embodiment of the chair tilting mechanism 100 of the present invention attached to a lounge chair 220 in accordance with the disclosed architecture. More specifically, the motor housing 110 is comprised of a tubular motor 111, shaft 112, gears 114 and end caps 113. The tubular motor 111 is located inside the motor housing 110 in such a manner that the shaft 112 is able to rotate in both a clockwise 170 and counter-clockwise 180 motion. Also located inside the motor housing 110 is a motor device that turns the shaft 112 in the applicable direction. The motor device may be comprised of a magnetic, electronics or other type of system that is capable of rotating the shaft 112 in both a clockwise 170 and counter-clockwise 180 motion. Preferably the motor is a stepper motor which allows the motor to advance the shaft and then the shaft is locked in position. Alternatively, if the motor is a continuous drive a lock may be engaged to hold the frame in the desired position.

Additionally, the shaft 112 is inserted into two gears 114. Each gear 114 is located on opposite ends of the shaft 112. An end cap 113, pin or other fastener is affixed to the end of the shaft 112 on each side securing the gears 114 in place. The fastening mechanism 116 may be any suitable mechanism for securing the gear 114 in place such as a clamp, threads, clips, pins, etc., provided that the same is capable of preventing the gear 114 from sliding off or about the shaft 112. Unless otherwise stated herein, each of the various components of the device 100 may be constructed from any suitable material such as, but not limited to, an aluminum, alloy, plastic, polystyrene, polyethylene or the like, provided that the same is relatively anti-corrosive, lightweight, strong and durable.

Additionally, the motor housing 110 is attached to a power source 120. The motor housing 110 may be fastened to the power source 120 through any suitable means to secure the motor housing 110 and the power source 120 together. In a preferred embodiment, the motor housing 110 and power source 120 would be fastened by means of a single molded material that would surround both the motor housing 110 and the power source 120. Alternatively, the motor housing 110 and the power source 120 may be removably attached to each other by any suitable material for use, such as leather, cord, chain, etc. that provides stability and supports the device 100 when installed on a chair 220 or lounge.

In a preferred embodiment, the power source 120 is a battery. The battery would preferably be easily removed from the tubular motor 111 and rechargeable or simply replaceable. The rechargeable batteries may be lithium ion, lithium polymer, or the like and will hold a charge for upwards of several months depending on use. The battery may also include disposable batteries, such as D-cell, C-cell, or the like. Alternatively, the power source 120 may be an electrical connection whereby the power source 120 is powered by inserting a plug into an electrical outlet.

As further illustrated in FIG. 2, the device 100 is attached to the chair cross brace 150 such that power source 120 is positioned immediately adjacent to the chair cross brace 150. The device 100 is positioned parallel to the surface and suspended between the chair cross brace 150 and the rack gear 130, thereby permitting the gear teeth 115 to mate and remain mated with the rack gear teeth 132. In a preferred embodiment, two straps 140 are placed entirely around the outer end 117 of the device 100 and the chair cross brace 150. However, the device 100 may be affixed to the chair cross brace 150 by any suitable mechanism for securing the device 100, such as hook and loop style fasteners, buttons, snaps, buckles, etc., provided the device 100 is supported such that the gears 114 remain mated to the rack gear 130.

As still further illustrated in FIG. 2, the gears 114 on the tubular motor 111 are positioned approximately the same distance apart to line up with the rack gears 130 located on the back support rod 151 of the chair 220. The gears 114 on the tubular motor 111 and rack gears 130 are connected through at a mating point 131. In a preferred embodiment, the mating point 131 is the location of the point of engagement between the gear teeth 115 and the rack gear teeth 132 to move the chair back 221 in an upward motion 200 and a downward motion 190. When the tubular motor 111 is engaged, the gears 114 turn in either a clockwise motion 170 or a counter-clockwise motion 180 depending on the direction the chair is to be moved.

As still further illustrated in FIG. 2, the back support rods 151 of the chair 220 may be manufactured from a pre-molded rack gear 130. Alternatively, the rack gear 130 may be a separate unit that is capable of attaching to the back support rods 151, thereby allowing the device 100 to be installed on any type of reclinable chair 220. For example, the rack may be attachable to the frame by adhesive, screws or other mechanical fasteners.

Figure 3:
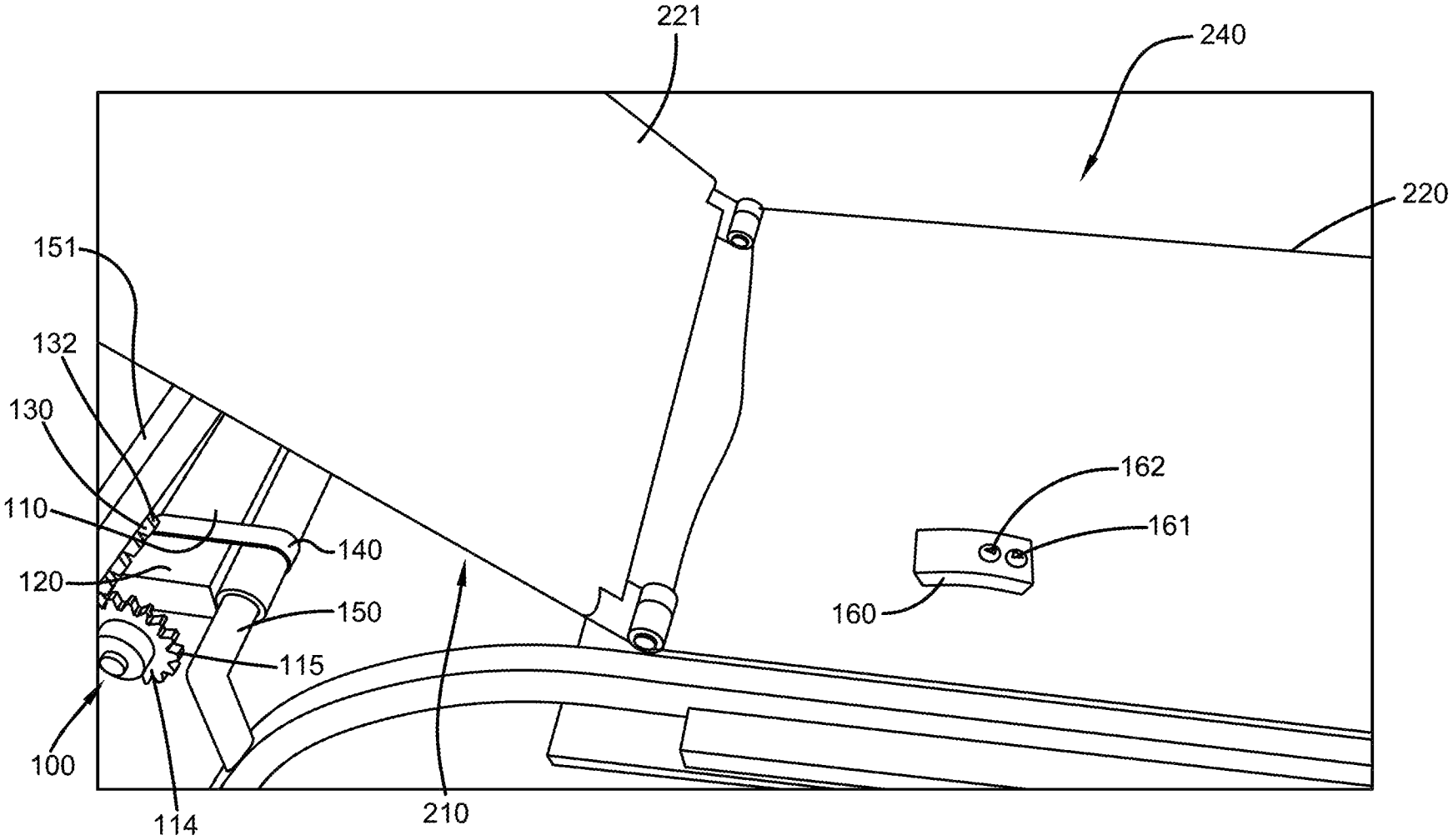
FIG. 3 illustrates a partial perspective view of one potential embodiment of the chair tilting mechanism of the present invention attached to a lounge chair in accordance with the disclosed architecture, and a remote control that is easily accessible to a user.
Figure 4:
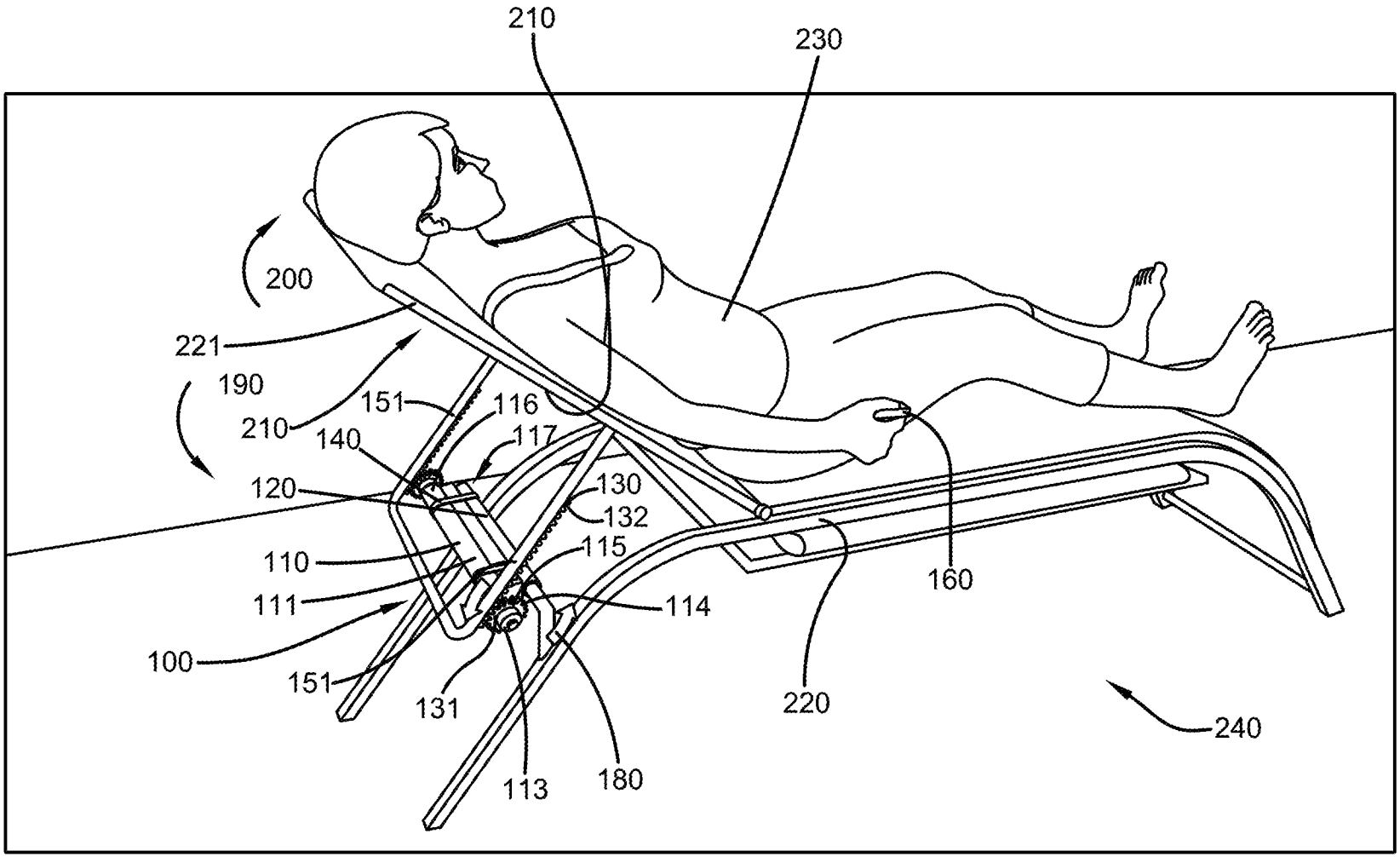
FIG. 4 illustrates a perspective view of a user using a remote control to control the operation of one potential embodiment of the chair tilting mechanism of the present invention attached to a lounge chair in accordance with the disclosed architecture.

As best shown in FIGS. 3 and 4, the remote control 160 in one embodiment has an upward reclining button 161 and a downward reclining button 162. The remote control 160 is generally rectangular in shape and may be ergonomically designed to best meet the needs of the user 230. In a preferred embodiment, the upward reclining button 161 and backward reclining button 162 are located on one half of the remote control 160 allowing space for the user 230 to comfortably hold the remote control 160 without depressing the buttons. The upward reclining button 161 and a downward reclining button 162 may be of any shape and size to meet the needs of the user 230, and may be the same or different colors than the remote control 160. The remote control 160 may be manufactured from any suitable material such as, but not limited to, plastic, metal or the like, provided that the same is relatively lightweight and durable. The remote control 160 would preferably contain a battery compartment on the underside. Alternatively, the remote control 160 could also be comprised of a wire affixed directly to the device 100.

Figure 5:
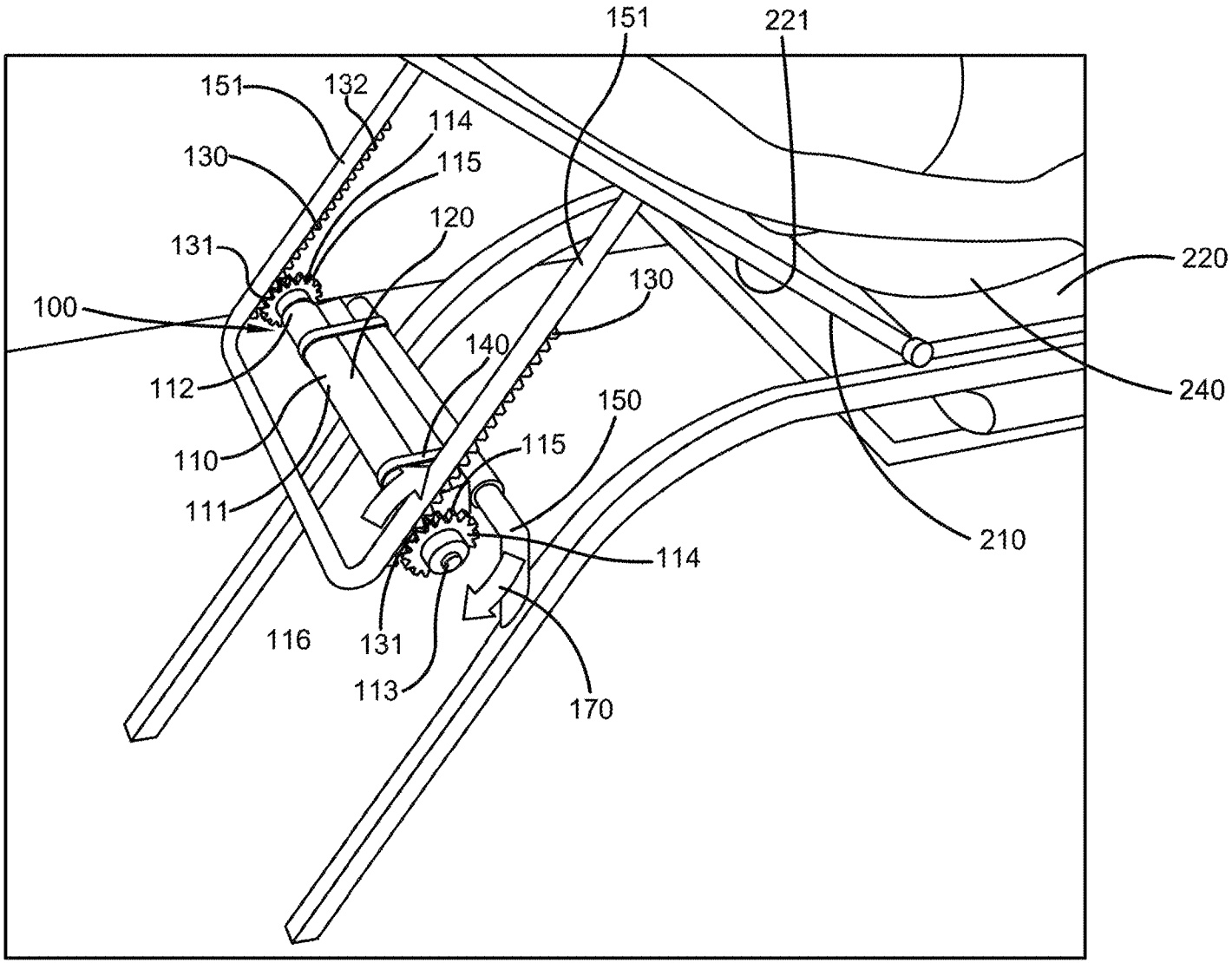
FIG. 5 illustrates a close-up perspective view of one potential embodiment of the chair tilting mechanism of the present invention attached to a lounge chair in accordance with the disclosed architecture, wherein the tilting mechanism is being used to adjust the back of the lounge chair to a fully upright position.

As best shown in FIGS. 3-5, when the upward reclining button 161 is depressed, the tubular motor 111 will turn in a clockwise motion 170. This, in turn, causes the gears 114 to also turn in a clockwise motion 170 thereby causing the gears 114 to move in a downward motion 190 along the rack gear 130 and the back support rods 151 to slowly straighten to an upright position. Conversely, when the backward reclining button 162 is depressed, the tubular motor 111 will turn in a counter-clockwise motion 180 thereby causing the gears 114 to move in an upward motion 190 along the rack gear 130. This, in turn, causes the back support rods 151, and the chair back 221, to slowly move to a position parallel with the floor.

Figure 6:
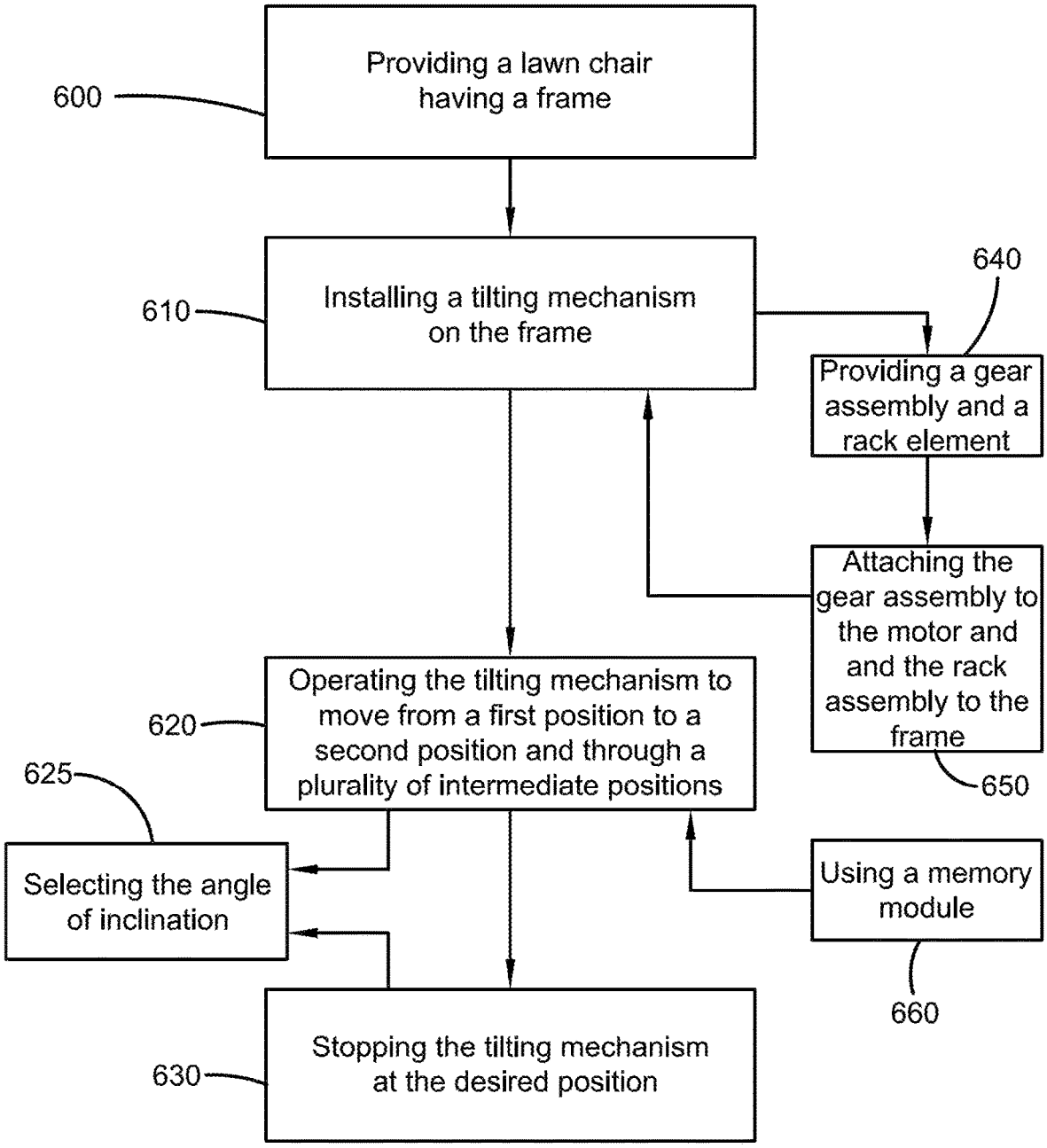
FIG. 6 illustrates a block diagram of one potential method of using the tilting mechanism of the present invention in accordance with the disclosed architecture.

FIG. 6 illustrates a block diagram of one potential method of using the tilting mechanism 100 of the present invention in accordance with the disclosed architecture. The method includes the steps of initially providing a lounge chair at step 600, and then installing a tilting mechanism 100 on the frame of the chair at step 610. The tilting mechanism 100 is operated to move from a first position to a second position and through a plurality of intermediate positions at step 620, and the mechanism is stopped at step 630 once the desired position has been achieved. An additional step may include selecting an angle of inclination at step 625. The step of installing the mechanism 100 may further include providing a gear assembly at step 640 and a rack assembly at step 650, and attaching the rack assembly to the frame. A further step may include the activation or use of a memory module at step 660 to select from one of a predetermined number of positions for the chair 220.

Figure 7:
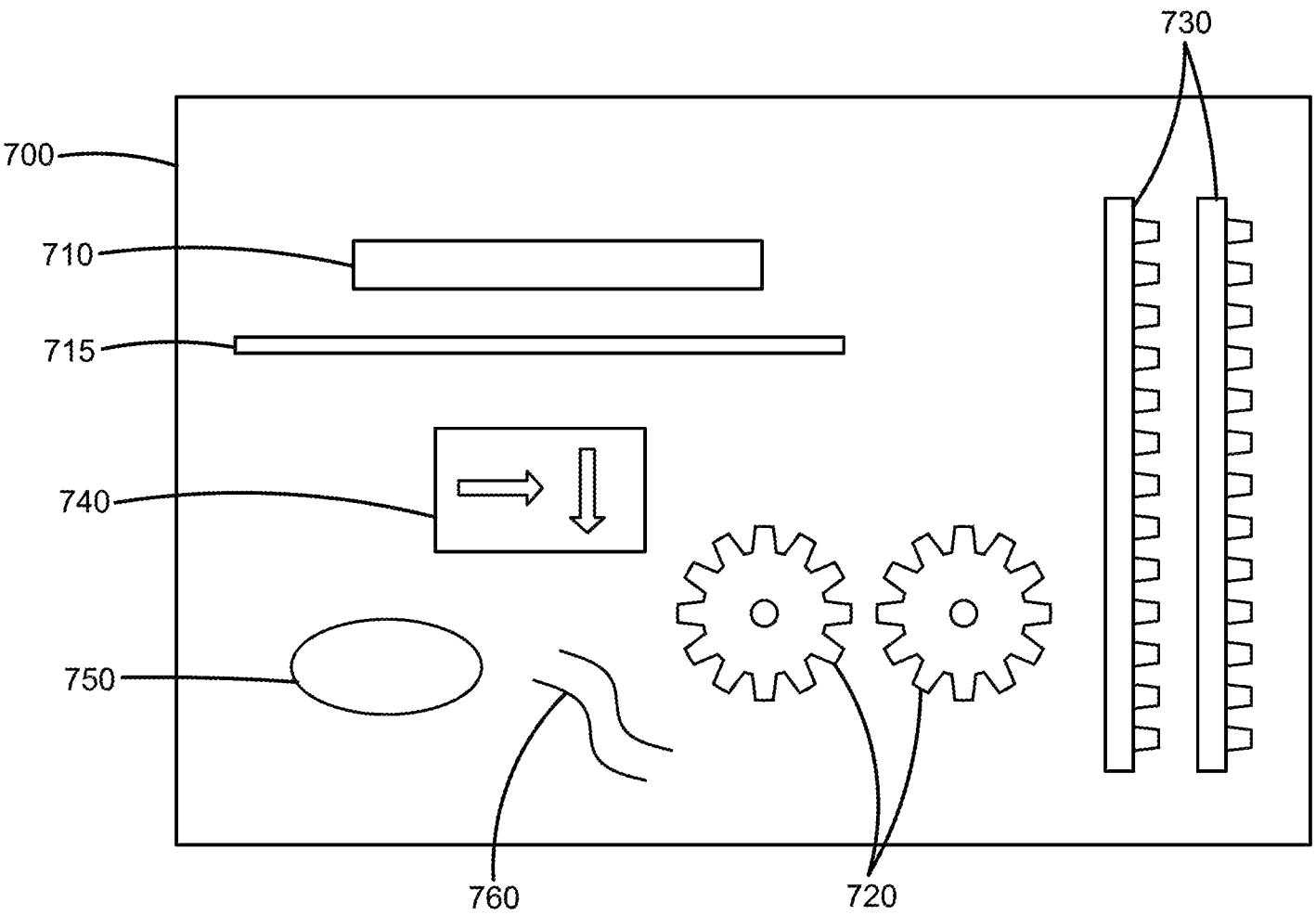
FIG. 7 illustrates a perspective view of one potential embodiment of a chair tilting mechanism kit of the present invention in accordance with the disclosed architecture, wherein the kit can be used to retrofit a lounge chair to make the chair adjustable.

FIG. 7 illustrates a perspective view of one potential embodiment of a chair tilting mechanism kit of the present invention in accordance with the disclosed architecture, wherein the kit can be used to retrofit a lounge chair 220 to make the chair adjustable. More specifically, the kit includes a package 700 having a motor 710 enclosed in a housing. A shaft 715 is inserted in the house, gears 720 are provided and one is positioned on each end of the shaft and secured in place. Racks 730 are provided to be secured on to the frame and in alignment with the gears and are sized and configured to receive the teeth of the gears. A controller 740 is provided to drive the motor so that the tiling mechanism can be used when installed on the frame. The kit 700 may also include one or more batteries 750 and straps or adhesive strips 760 to secure the various components to the frame.

Notwithstanding the forgoing, the chair tilting device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the chair tilting device 100 and its various components as shown in the FIGS. are for illustrative purposes only, and that other configurations of the chair tilting device 100 are well within the scope of the present disclosure.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A tilting mechanism for a chair having a frame and a back section, the tilting mechanism comprising:

a motor enclosed within a housing, wherein the motor is comprised of a shaft having a gear provided on each end of the shaft;

a rack provided on a portion of the back section of the frame of the chair, wherein the rack is engaged the gears; and a controller for actuating the motor to move the back section of the chair to at least a first position and a second position.

2. The tilting mechanism as recited in claim 1, wherein the controller comprises an upward indicator, a downward indicator and an angle of inclination indicator.

3. The tilting mechanism as recited in claim 2, wherein the controller further comprises a plurality of pre-selected memory positions for the back section of the chair.

4. The tilting mechanism as recited in claim 1, wherein the first position is fully upright and the second position is fully reclined.

5. The tilting mechanism as recited in claim 4, wherein a plurality of intermediate angles of inclination are provided between the first position and the second position.

6. The tilting mechanism as recited in claim 1, wherein the motor is used to turn the gears in a clockwise direction or a counter-clockwise direction.

7. The tilting mechanism as recited in claim 1, wherein the motor is secured to the frame of the chair by one of a strap or a strip of adhesive.

8. The tilting mechanism as recited in claim 1, wherein the motor is connected to a power source.

9. The tilting mechanism as recited in claim 8, wherein the power source is one of a battery, an electric outlet or a solar panel.

10. The tilting mechanism as recited in claim 9, wherein the battery a rechargeable battery or a disposable battery.

11. A method of using a tilting mechanism for a lounge chair, the method comprising the steps of:

providing the lounge chair, wherein the lounge chair is comprised of a frame and a back section;

installing a tilting mechanism on the frame of the lounge chair, wherein the tilting mechanism comprises a motor enclosed in a housing and secured to the frame and a controller for operating the motor;

operating the tilting mechanism to move the back section from a first position to a second position; and stopping the tilting mechanism when the back section is at a desired position.

12. The method as recited in claim 11 further comprising a step of providing a gear assembly and a rack assembly after the step of providing the lounge chair.

13. The method as recited in claim 12, wherein each of the gear assembly and the rack assembly is attached to the frame of the lounge chair and are in operative alignment with one another.

14. The method as recited in claim 13, wherein the step of operating includes the use of the controller and further wherein the controller is comprised of an angle of alignment indicator, an up button and a down button.

15. The method as recited in claim 14, wherein the controller comprises a plurality of pre-set memory options to position the back section in a pre-set memory position.

16. The method as recited in claim 15, wherein the controller moves the back section through a plurality of intermediate positions between the first and second positions.

17. The method as recited in claim 16, wherein the first position is a fully upright position.

18. The method as recited in claim 17, wherein the second position is a fully reclined position.

19. A kit for use in retrofitting a lounge chair, the kit comprising:

a package;

a motor enclosed in a housing and a shaft for insertion in the housing and in engagement with the motor;

a plurality of gears having teeth;

a plurality of racks sized and configured to work with the teeth of the plurality of gears; and a controller for operating the motor.

20. The kit as recited in claim 19, wherein the kit further comprises a battery and a fastening means for securing at least one of the motor or the plurality of racks to a frame of the lounge chair.

* * * * *